US008919174B2

(12) United States Patent
Schurder et al.

(10) Patent No.: US 8,919,174 B2
(45) Date of Patent: Dec. 30, 2014

(54) FRONT ACTION SEALING TOOL

(75) Inventors: Lawrence J. Schurder, Barrington, IL (US); Michael T. Schmitt, Hawthorn Woods, IL (US); Walter L. Boss, Lindenhurst, IL (US); Daniel R. Pearson, Ingleside, IL (US); Wayne J. Skonieczny, Jr., Cary, IL (US)

(73) Assignee: Signode Industrial Group LLC, Glenview, IL (US)

( * ) Notice: Subject to any disclaimer, the term of this patent is extended or adjusted under 35 U.S.C. 154(b) by 919 days.

(21) Appl. No.: 13/028,634

(22) Filed: Feb. 16, 2011

(65) Prior Publication Data

US 2011/0219845 A1 Sep. 15, 2011

Related U.S. Application Data

(60) Provisional application No. 61/313,226, filed on Mar. 12, 2010.

(51) Int. Cl.
*B25B 7/00* (2006.01)
*B25B 7/20* (2006.01)

(52) U.S. Cl.
CPC ..... *B25B 7/20* (2013.01)
USPC ..... 72/409.01; 72/482.92; 29/283.5

(58) Field of Classification Search
USPC ..... 72/409.01, 409.08, 409.09, 409.19, 72/481.1, 416, 482.91, 482.92; 29/282, 29/283.5
See application file for complete search history.

(56) References Cited

U.S. PATENT DOCUMENTS

| | | | | |
|---|---|---|---|---|
| 2,035,686 | A * | 3/1936 | Briegel | 72/409.01 |
| 3,345,856 | A * | 10/1967 | Werner et al. | 72/409.01 |
| 4,048,839 | A * | 9/1977 | Peterpaul | 72/409.01 |
| 4,480,460 | A * | 11/1984 | Bush et al. | 72/409.01 |
| 5,307,664 | A * | 5/1994 | Homm | 72/409.01 |

OTHER PUBLICATIONS http://www.merriam-webster.com/dictionary/gap; Accessed Jun. 2, 2014.*

(Continued)

*Primary Examiner* — Shelley Self
*Assistant Examiner* — Pradeep C Battula
(74) *Attorney, Agent, or Firm* — Levenfeld Pearlstein, LLC

(57) ABSTRACT

A crimping tool for applying a seal to strap material includes a tool head having pairs of jaws disposed in the tool head and operably mounted thereto, each pair including opposingly oriented jaw elements. Each pair of jaws is spaced from its adjacent pair and includes an upper and lower pivot openings. A shear is positioned between adjacent pairs of jaw elements. The shears extend between the jaw elements and include opposing openings that align with the jaw element upper openings. A pair of handles, each having a terminal end having first openings that align with the jaw element lower openings and are operably connected to one another at respective pivot openings. The tool includes at least one side plate having a pair of upper openings each aligned with the jaw element upper openings and the shear openings. The plate includes a centrally disposed notched opening. A pair of handle pins are disposed in respective handle first openings and jaw element lower openings and a pair of link pins are disposed in respective side plate upper openings and respective jaw element upper openings and a shear opening. A pivot pin is disposed in the side plate notched opening and in the handle pivot openings. The shear can be reversible to accommodate different sizes of seals.

16 Claims, 9 Drawing Sheets

(56) References Cited

OTHER PUBLICATIONS http://www.merriam-webster.com/dictionary/notch; Accessed Jun. 2, 2014.*

Midwest Industrial Packaging 2009 Plastic Packaging Tools Products List downloaded from web site: http://www.miptools.com/Products/PlasticPackagingTools/tabid/823/Default.aspx.

Midwest Industrial Packaging 2009 Steel Packaging Tools Products List downloaded from web site: http://www.miptools.com/Products/SteelPackagingTools/tabid/822/Default.aspx.

Signode 2010 Products Catalog (Manual Sealers for Steel Strapping) p. 8.

Signode 2010 Products Catalog (Manual Tensioners and Sealers for Plastic Strapping) p. 19.

* cited by examiner

FRONT ACTION SEALING TOOL

CROSS-REFERENCE TO RELATED APPLICATION DATA

This application claims the benefit of U.S. Provisional Patent Application Ser. No. 61/313,226, filed Mar. 12, 2010.

BACKGROUND

Strapping material is used in a wide variety of applications to secure or bundle loads. The strap material is typically metal or plastic and can be applied to the load using either a manual sealer or a powered sealer. Powered sealers can be pneumatic or electric and can be hand-held or machine-frame type machines. Non-powered (manual) sealers are typically hand-held or hand-operated tools.

The seals (for both metal and plastic strap) can be of the seal-less type or of the crimp seal type. In a seal-less seal or joint, the material is welded to itself (if plastic) or mechanically joined as by locking cuts and projections. Crimp seals, on the other hand, use a band that is bent or wrapped around overlapping portions of strap and mechanically crimped onto the strap. In such a joint, the seal is compressed onto the strap material and the strap material is deformed so as to be secured in the seal.

There are two principal types of seals that are configured based upon the size or width of the strap on which the seal is positioned. For both ½ and ⅝ inch strap, the seals are formed with a base portion and upstanding legs. A top portion of the seal extends from one of the legs, inwardly, forming an asymmetrical design. The legs are commonly referred to as a long leg (the leg that has the top portion of the seal extending therefrom) and a short leg (that leg that is only the upstanding side portion). For ¾ inch strap, the seal is symmetrical. That is, the top portion of the seal is formed from inwardly extending portions of both legs.

In many such seals, the seal is cut, at least in part and is urged into the material to create an interference type of fit. In this manner, portions of the strap and portions of the seal are forced from their respective bodies, into the other material. That is, the strap and seal are cut and bent into each other so that the materials are not only held by compression, but also by interference of the crimp seal with the strap "pulling" from the seal.

Known tools used to crimp the seal onto the strap are leverage-type (or lever-action) tools that include a pair of handles that are linked to jaws that pivot inwardly to compress the seal. The seal is held between the jaws and rests on an anvil surface of a shear. In such known tools, a set of jaws and shears are stacked to increase the area over which compression of the seal occurs and the number of locations at which the seal is crimped.

As with many such lever-action tools, in the open position (the crimp-receiving position), the tool tends to lock out. That is, there is a point in the pivot action after which the tool locks into the open position. At and beyond this lock-out position, manipulation of the tool is required to move the tool back toward the closed position.

When in the closed position (the seal-forming position), with a seal in the jaw, such known tools tend to urge to the open position due to the pivot location and configuration. This can result is poor and/or incomplete seal formation.

Moreover, such known tools are single-size tools. That is, the tool can only be used to form seals of a single size. As such, when different size seals are used, a separate tool is required for each seal size. For seal sizes of ½ and ⅝ inch (the asymmetrical seals), the jaw elements are also asymmetrical. One jaw element has an elongated blade that is designed to contact the long leg, while the other element has a shorter leg that is designed to contact the short leg. As such, the seal can only be positioned in the tool in one direction, or again, the result can be poor and/or incomplete seal formation.

Accordingly, there is a need for a front action seal tool for use with strap material. Desirably, such a tool is used to apply or install a high reliability crimp seal type of seal on overlapping strap material. Most desirably, such a tool applies or installs the crimp seal without damage to the underlying strap material. More desirably still, such a crimp seal is applied to the strap with minimal force, and includes features to prevent locking the tool out when fully open and premature opening when the tool is closed. Such a tool can be used with seals of different sizes, without having to change the jaw elements, and can be used with the seal at any position in the tool.

BRIEF SUMMARY

Various embodiments of the present disclosure provide a crimping tool for applying or installing a deformable crimp seal onto overlapping layers of strap material which includes a tool head, pairs of jaws disposed in the tool head, a shear position between jaw elements, a pair of handles for actuating the jaws and a side plate.

The pairs of jaws are disposed in the tool head. Each pair of jaws includes opposingly oriented jaw elements. The pairs of jaws are spaced from adjacent pairs of jaws. Each jaw element includes an upper pivot opening and a lower pivot opening.

The shear is positioned between adjacent pairs of jaws. The shear extends between the jaw elements and includes an anvil surface on which the seal rests. The shear includes opposing openings aligned with the jaw element upper openings.

The handles each have a terminal end having first openings that are aligned with the jaw element lower openings and are operably connected to one another at respective pivot openings.

The side plate has a pair of upper openings, each aligned with the jaw element upper openings and the shear openings. The side plate includes a centrally disposed notched opening.

The tool includes a pair of handle pins, each disposed in a respective handle first opening and a respective jaw element lower opening. The tool further includes a pair of link pins, each disposed in a respective side plate upper opening and a respective jaw element upper opening and a shear opening.

A pivot pin is disposed in the side plate notched opening and in the handle pivot openings. When the tool is closed or in a sealing position, an angle of less than or equal to about 90 degrees is defined by the respective center lines of the link pins, the handle pins and the pivot pin. When the tool is open to receive a crimp seal, an angle of about 180 degrees is defined by the two handle pins and the link pin.

The tool can include stops to prevent over rotation of the handles in the open position. In an embodiment, the stops are pins disposed in the shears.

The tool can include one or more connecting plates. Each connecting plate has two openings, a first opening for receipt of the handle pin to align with one of the handle first openings and a respective jaw element lower opening and a second opening for receipt of the link pin to align with the handle pivot openings and the side plate slotted opening.

The shear can include a receiving region in which the deformable crimp seal is positioned. The shear can be configured having first and second receiving regions in first and second sides, respectively. The first and second receiving regions can be configured to support different sizes of seals. A smaller of the receiving regions can be defined by a notch in the anvil surface of the shear.

DETAILED DESCRIPTION

Figure 1:
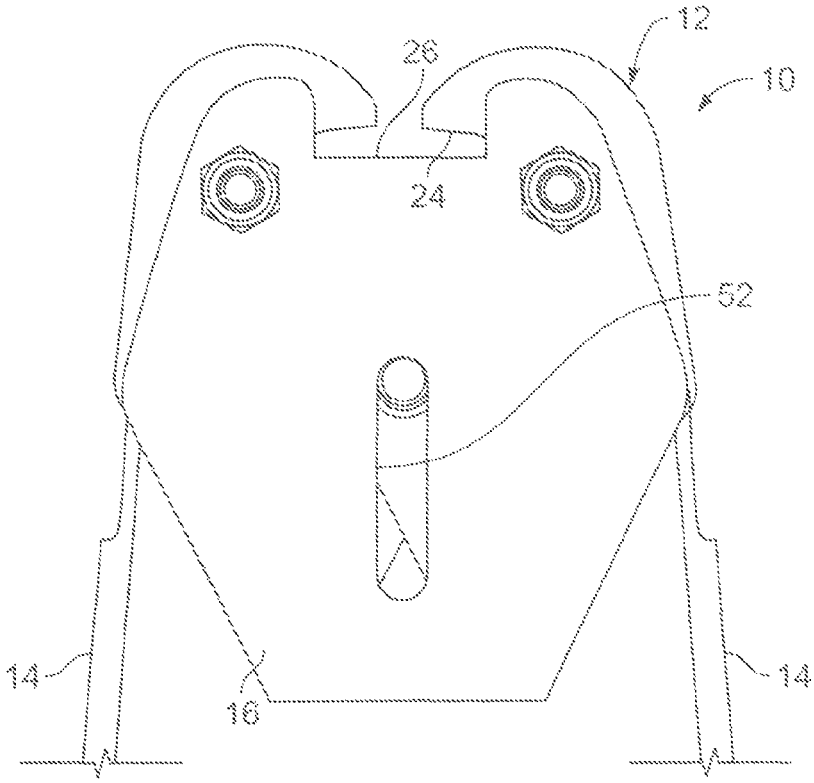
FIG. 1 is a partial front view of an embodiment of a front action sealing tool, the illustrated tool being configured for use with larger size seals, such as ¾ inch seals.

While the disclosed apparatus is susceptible of embodiment in various forms, there is shown in the drawings and will hereinafter be described a exemplary embodiments with the understanding that the present disclosure is to be considered an exemplification of the apparatus and is not intended to be limited to the exemplary embodiments illustrated.

Figure 2:
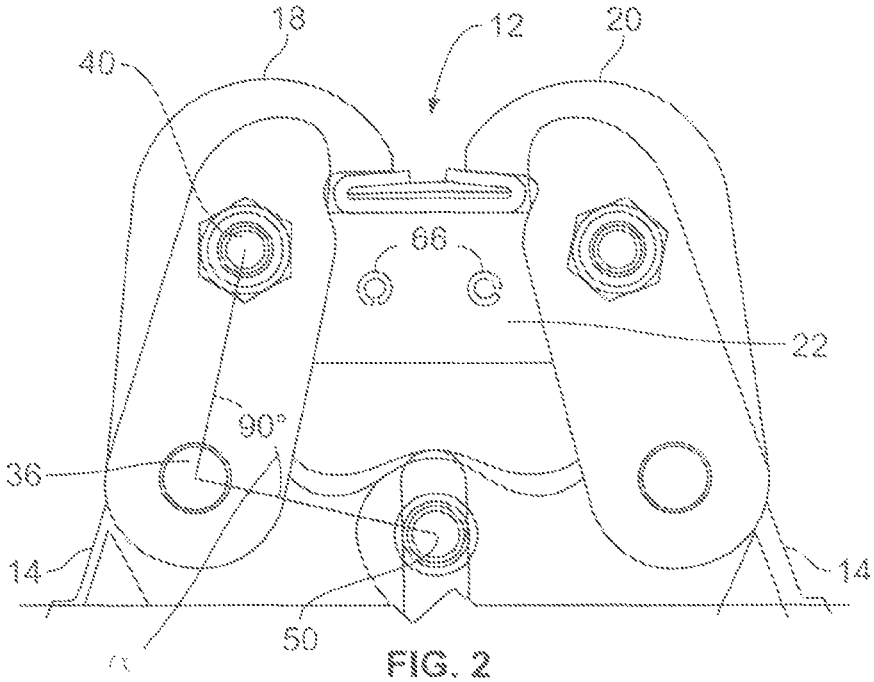
FIG. 2 is schematic illustration of the tool of FIG. 1, with the side plate shown, but with the components behind visible, the tool being shown prior to crimping a seal on strap.

Referring now to the figures and in particular to FIGS. 1 and 2, there is shown a partial front view of the top of an embodiment of a front action sealing tool 10. The tool includes a head 12, a pair of handles 14, a pair of side plates 16 (one shown), multiple jaws elements 18 (each pair forming a jaw 20) and multiple shear elements or shears 22.

Each jaw element 20 includes an inwardly oriented crimping portion 24 that engages the seal S to urge the seal inward or closed. The shears 22 each include an anvil surface 26 on which the base of the seal S rests as the crimping portion 24 acts on the seal S to close or form the seal.

The jaws 20 and shears 22 are stacked on one another to form an assembly 28. The jaws 20 have upper 30 and lower 32 pivot openings. The lower pivot openings 32 align with openings 34 in the respective handles 14 and are connected to the handles 14 by handle pins 36. The upper openings 30 align with openings 38 in the shears 22 and are connected to the shears by link pins 40. The upper openings 30 and shear openings 38 also align with openings 42 in the side plates through which the link pins 40 also insert. The illustrated tool 10 includes four pairs of jaw elements 20 (four jaws 18) and three shears 22.

The handle ends, at the head 12, are bifurcated as indicated at 44. In this manner, the ends capture the jaw/shear assembly 28 between the bifurcations and between the handles 14. The terminal ends 46 of the handles have a pivot opening 48 at which the handles 14 are pinned (by a pivot pin 50) to one another. The pivot pin 50 also traverses through a slotted opening 52 in each of the side plates 16. A lower most opening 54 in each side plate receives a pin 56 that secures the plates to one another which, along with the link pins 40, maintains the head 12 in a fastened (bolted) assembly. The free ends 58 of the handles 14 are, of course, configured for a user to grip, to use the tool 10.

A pair of connecting plates 60 are positioned within the head 12. The connecting plates 60 each have a pair of openings 62, 64. The pivot pin 50 is positioned through one of the openings 62 and the handle pin 36 is positioned through the other opening 64. The connecting plates 60 are positioned inboard of the jaw/shear assembly 28.

One feature of the present tool is a pair of stops 66 mounted in the head 12. The stops 66 provide an interference to prevent over rotation of the handles 14 into the open position. It has been found that if the handles 14 are over-rotated, the tool 10 can lock into the open position. It will be appreciated that this can result in an unwanted condition, in which the tool 10 is difficult to close, toward the crimping or sealing position, and undue manipulation of the tool 10 may be required to position the handles for use. In the illustrated tool, the stops 66 are formed as pins that are positioned in the shears 22. The pins 66 provide a physical stop to handle 14 over-rotation. Other ways in which to provide the interference or stop feature can be physical protuberances on the shears 22 or the like, which other features are within the scope and spirit of the present disclosure.

Figure 3:
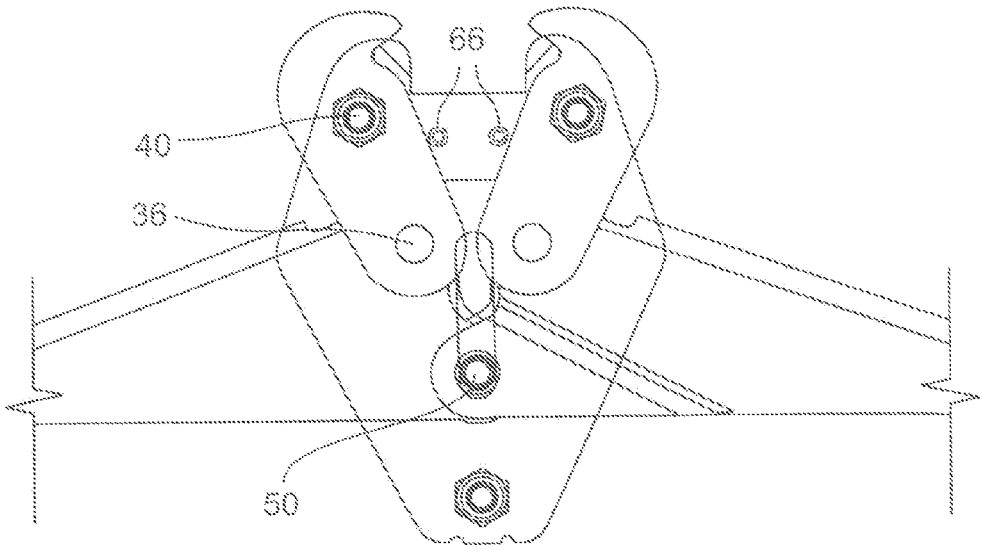
FIG. 3 is a schematic illustration similar to FIG. 2, with the tool in an open position and showing the tool stops interacting with the jaws.

Use of the tool 10 is best seen by reference to FIGS. 2 and 3. FIG. 3 shows the tool 10 in an open condition, ready for receipt of the seal S and strap T. The handles 14 are pivoted outwardly and the jaws 18 are spread open. The pivot pin 50 is in a downward position in the slotted opening 52.

With the seal S positioned on the shears 22 and the strap in the center of the seal S, the handles 14 are pivoted toward one another. This brings the jaws 18 inward and downward onto the seal S (to the crimped position). The sides of the seal S are pressed inward (and downward) and the seal is formed. With the inward pivoting of the handles 14, the pivot pin 50 moves upward in the slotted opening 52 (see, e.g., FIGS. 1 and 2). It will be appreciated by those skilled in the art that the seal S is of a deformable material, such as metal.

As seen in FIG. 2, when the seal S is crimped, the position of the various component of the tool 10 are such that an angle $\alpha$ is defined by the respective center lines (axes) of the link pins 40, the handle pins 36 and the pivot pin 50. The angle $\alpha$ is, when the tool 10 is in the crimped position, at less than or about 90 degrees. This angle $\alpha$ provides high leverage of the jaws 18, without over-rotation of the handles 14, and without a subsequent reduction in force and/or leverage at the jaws 18. The crimped position is that position at which the closing effort is greatest and, as such, the 90 degree angle $\alpha$ is the angle at which maximum force is applied.

Figure 4:
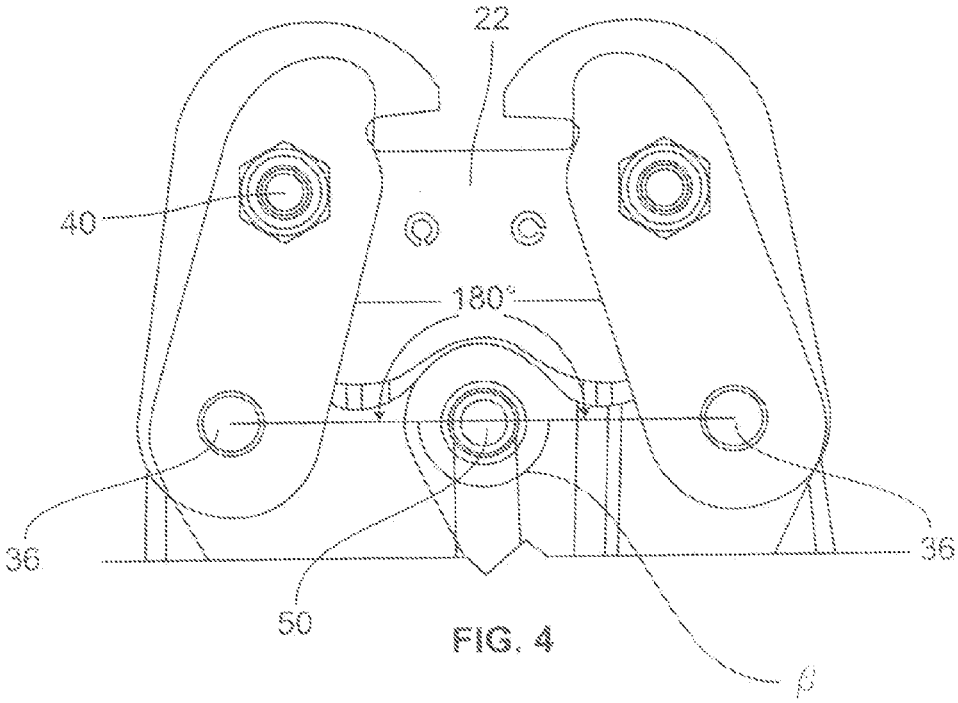
FIG. 4 is an illustration similar to FIG. 2, but showing the tool in a position in which it is closed to crimp a seal (the crimped position)
Figure 5:
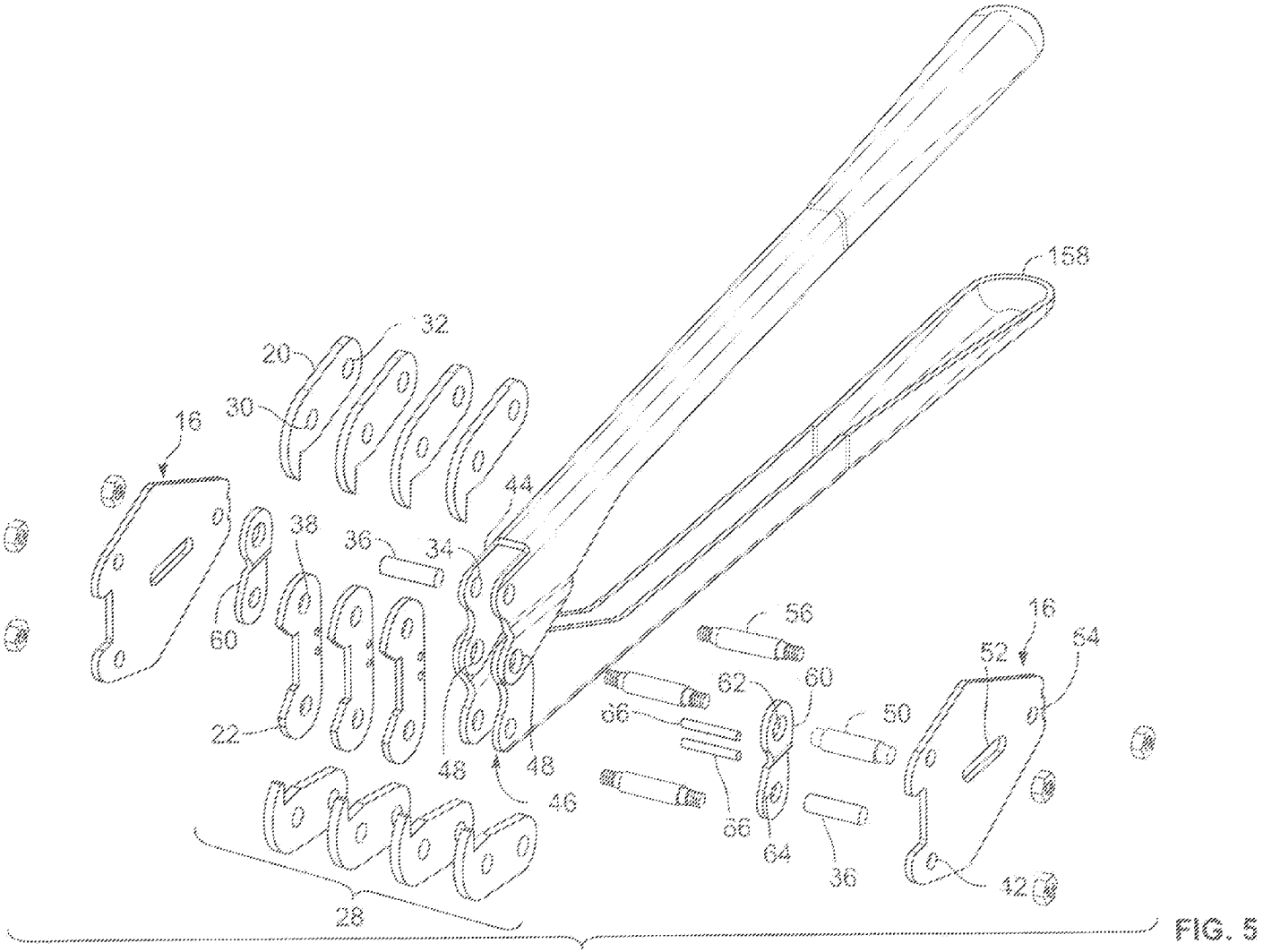
FIG. 5 is an exploded view of the tool.
Figure 6:
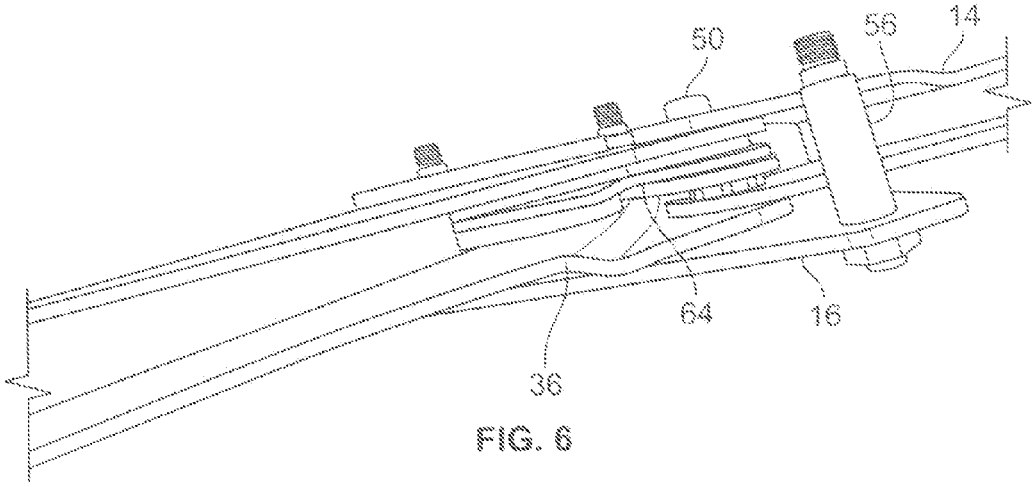
FIG. 6 is a view of the tool, looking at the tool head, as seen from between the handles, and shown with one side plate removed for clarity of illustration of the jaws, shears and handles.
Figure 7A:
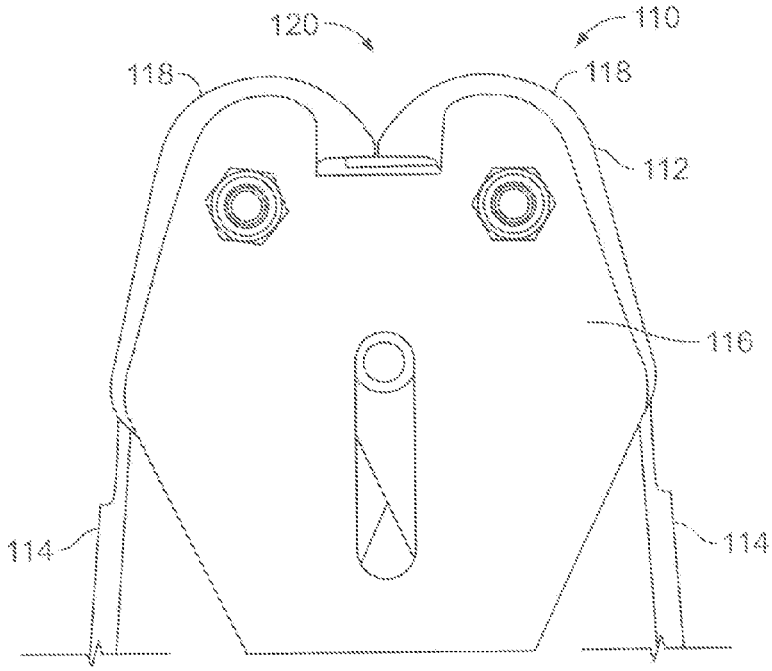
FIGS. 7A and 7B are partial front views of another embodiment of the front action sealing tool configured for use with smaller seals, such as ½ and ⅝ inch seals, FIG. 7A showing the tool set for use with ½ seals and shown with the side plate in place, and FIG. 7B showing the tool without the side plate for clarity of illustration.
Figure 7B:
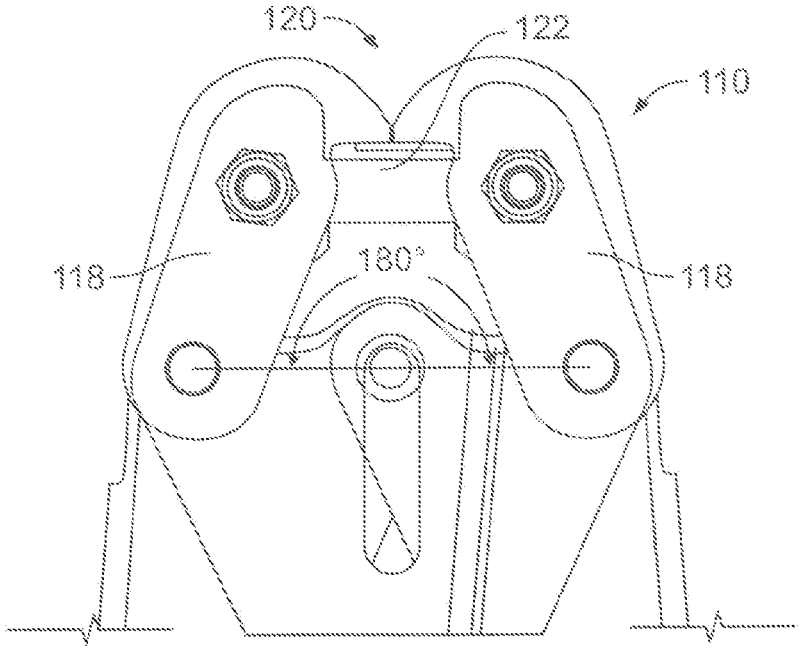
Figure 8:
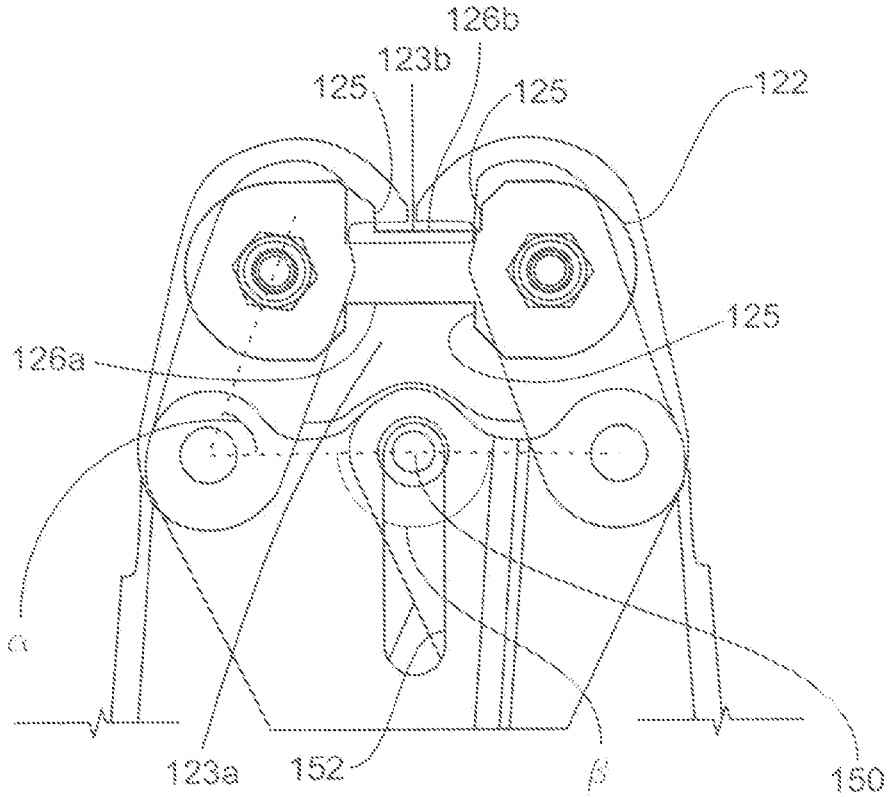
FIG. 8 is a schematic illustration of the tool of FIGS. 7A and 7B showing the shear in place for use with a ½ seal.

As seen in FIG. 4, when the tool 10 is closed, with or without a seal S in the jaws 18, an angle $\beta$ is defined by the two handle pins 36 and the pivot pin 50. When closed, the angle approaches about 180 degrees. This feature prevents over-rotation of the handles 14 and a subsequent reduction in force and/or leverage at the jaws 18. This also prevents the handles 14 from prematurely opening after the seal is formed.

Another embodiment of the tool 110 is illustrated in FIGS. 7A-12. This embodiment of the tool 110 is similar to that shown in FIGS. 1-6 and includes a head 112, a pair of handles 114, a pair of side plates 116 (one shown), multiple jaws elements 118 (each pair forming a jaw 120) and multiple shear elements or shears 122. The illustrated shears are reversible and are configured to accommodate different seal sizes (which are used for different sizes of strap material). The illustrated embodiment is configured with a shear for use with seals for ½ inch and ⅝ inch strap.

The shears 122 each include two seal receiving regions or notches 123*a*, 123*b*, each defined by respective anvil surfaces 126*a* and 126*b*, on which the base of the seal S rests, and upstanding guide walls 125 to position the seal S laterally within the shear 122.

Figure 9A:
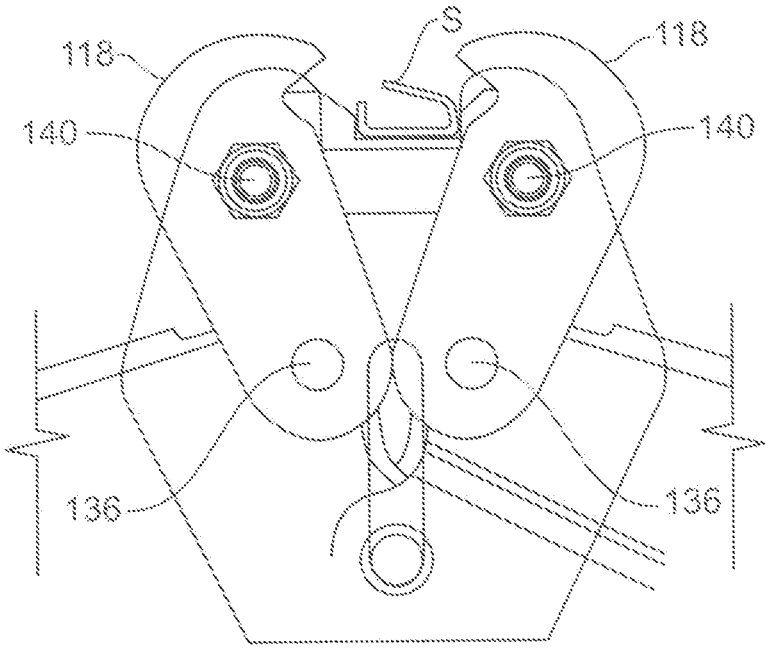
FIGS. 9A and 9B are views of the tool with a ½ inch seal in place, in both orientations of the seal in the jaw.
Figure 9B:
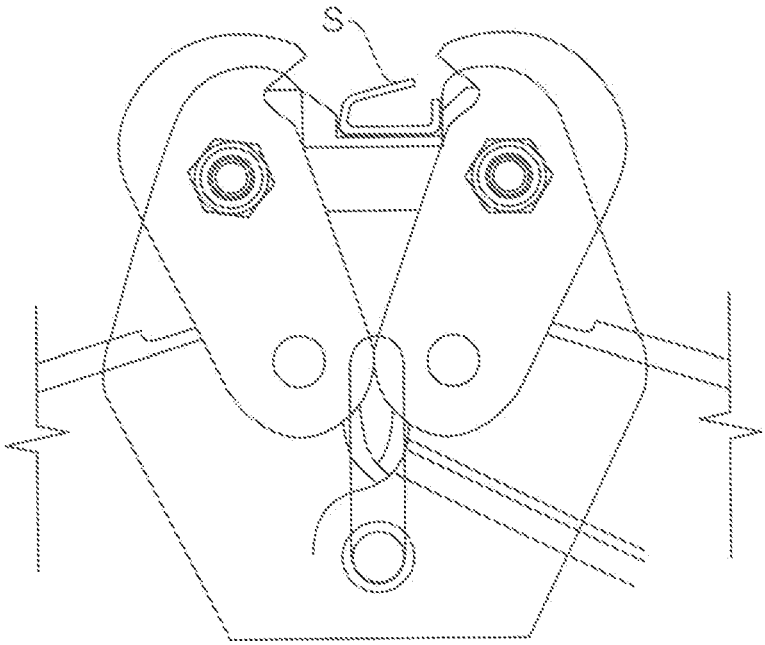
Figure 10A:
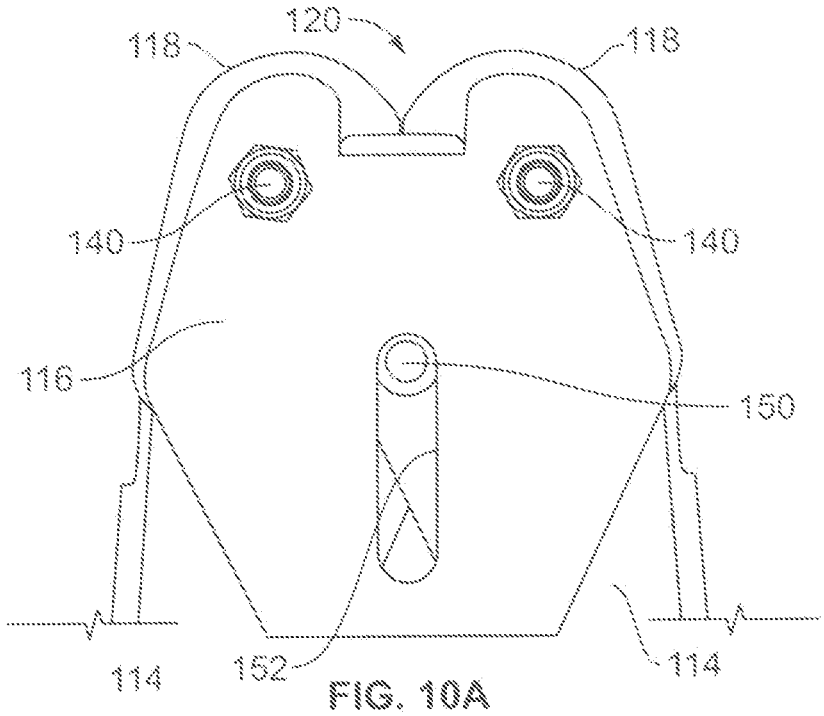
FIGS. 10A and 10B are views similar to that of FIGS. 7A and 7B, but with the tool set of use with ⅝ inch seals.
Figure 10B:
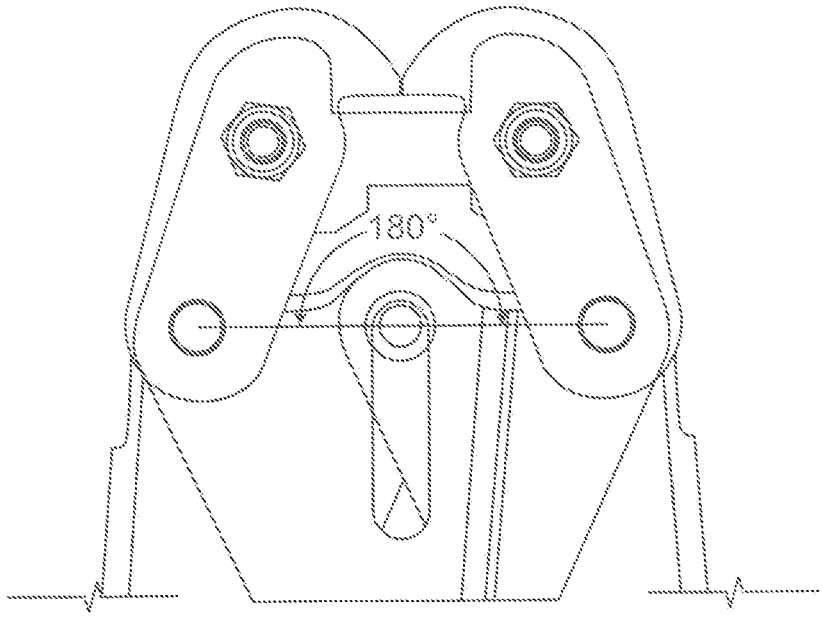
Figure 11:
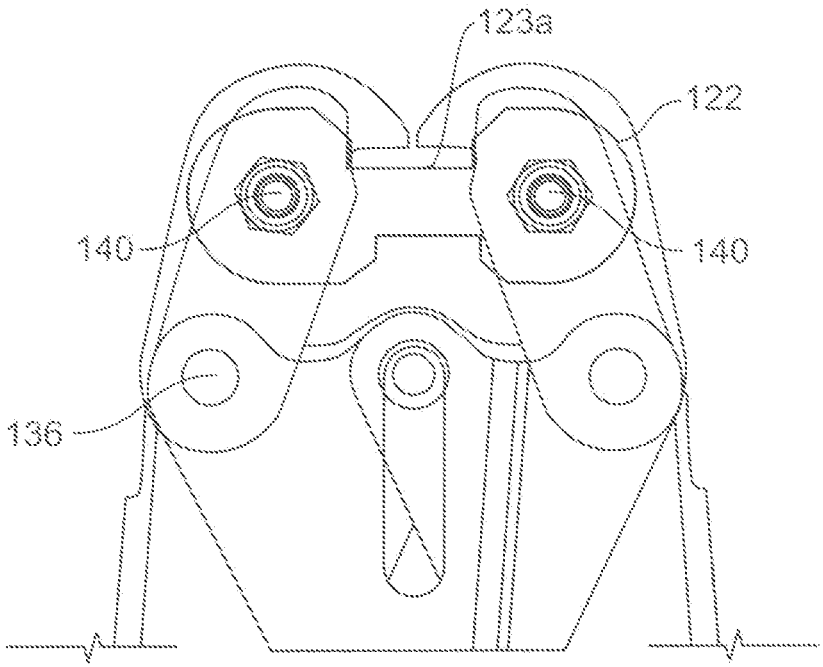
FIG. 11 is a view similar to FIG. 8 showing the shear in place for use with a ⅝ inch shear.
Figure 12:
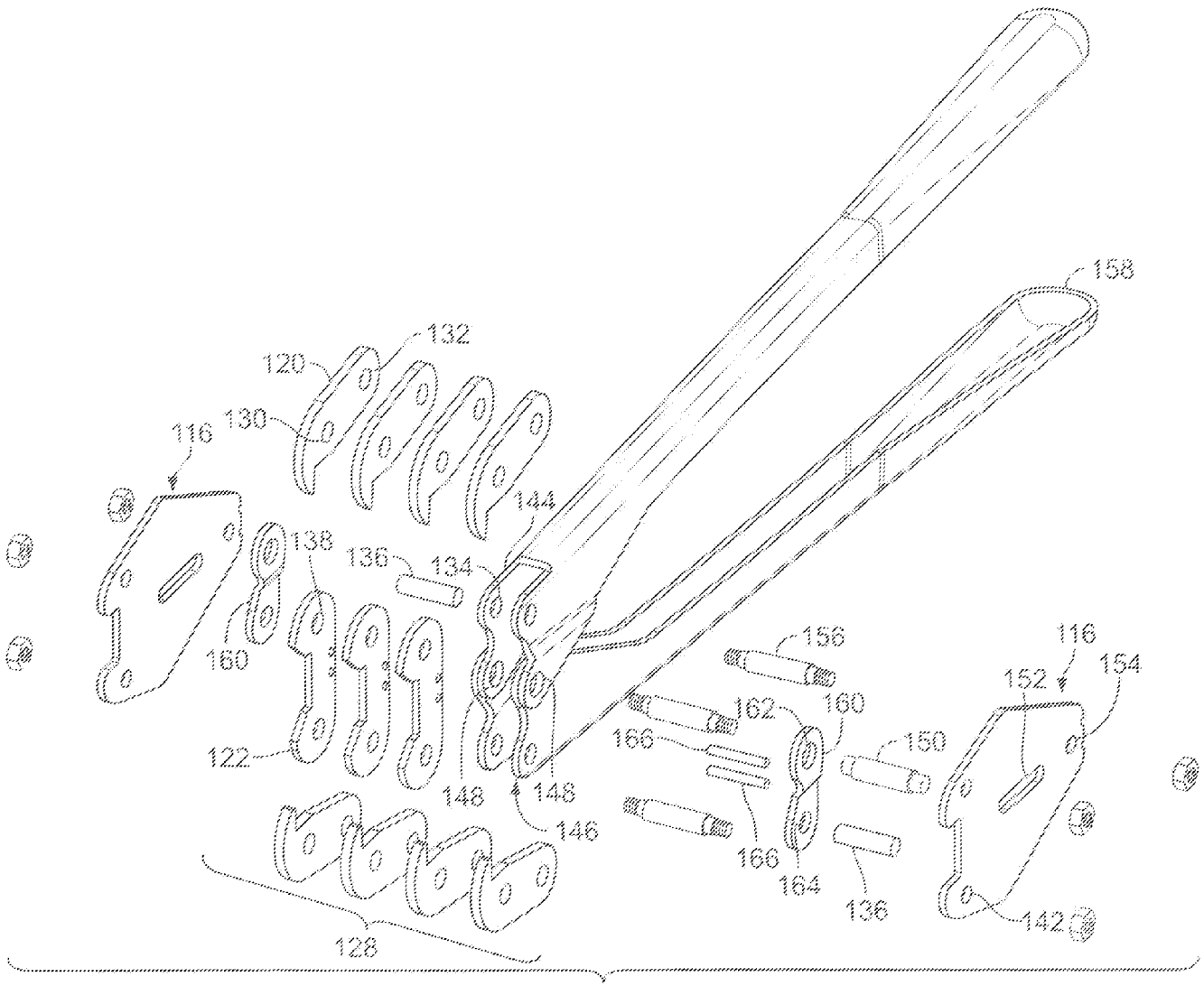
FIG. 12 is an exploded view of the tool of FIGS. 7A-11.

Receiving region 123*a* is configured for a larger size seal, for example, a ⅝ inch seal, and is symmetrically positioned, laterally, in the shear 122. Receiving region 123*b* is configured for a smaller seal, for example, a ½ inch seal, and is laterally offset in the shear 122. Advantageously, even though the receiving region 123*b* is offset, that is, closer to one of the jaw elements 118 than the other jaw element, the tool 110 will function properly to crimp the seal S, regardless of how the seal S is positioned in the tool 110, as illustrated in FIGS. 9A and 9B, as the crimping portion 124 acts on the seal S to close or form the seal. This eliminates the need to rotate or reverse the tool 110 when using the tool 110 on a smaller seal.

In the illustrated embodiment of the tool 110, the jaws 120 and shears 122 are stacked on one another to form an assembly 128. The jaws 120 have upper 130 and lower 132 pivot openings. The lower pivot openings 132 align with openings 134 in the respective handles 114 and are connected to the handles 114 by handle pins 136. The upper openings 130 align with openings 138 in the shears 122 and are connected to the shears 122 by link pins 140. The upper openings 130 and shear openings 138 also align with openings 142 in the side plates 116 through which the link pins 140 also insert. The tool 110 can also include multiple pairs of jaw elements 120 and shears 122.

The handle ends, at the head 112, are bifurcated as indicated at 144. In this manner, the ends 144 capture the jaw/shear assembly 128 between the bifurcations and between the handles 114. The terminal ends 146 of the handles have a pivot opening 148 at which the handles 114 are pinned (by a pivot pin 150) to one another. The pivot pin 150 also traverses through a slotted opening 152 in each of the side plates 116. A lower most opening 154 in each side plate receives a pin 156 that secures the plates to one another which, along with the link pins 140, maintains the head 112 in a fastened assembly. The free ends 158 of the handles 114 are, of course, configured for a user to grip, to use the tool 110.

The connecting plates 160 are positioned within the head 112. The connecting plates 160 each have a pair of openings 162, 164. The pivot pin 150 is positioned through one of the openings 162 and the handle pin 136 is positioned through the other opening 164. The connecting plates 160 are positioned inboard of the jaw/shear assembly 128.

During operation or use of the tool 110, a seal S is selected that corresponds to the size at which the tool 110 is set. For example, if the tool 110 is set for use with a smaller seal (as illustrated in FIGS. 7A-7B through 9A-9B), an appropriate size seal is used. The tool 110 is opened, ready for receipt of the seal S and strap (not shown), with the handles 114 pivoted outwardly, and the jaws 120 open. The pivot pin 150 is in a downward position in the slotted opening 152. A seal S is positioned on the shears 122 in the receiving region and, the handles 114 are pivoted toward one another. This brings the jaw elements 118 inward and downward onto the seal S. The seal S is crimped (pressed inward and downward) and the crimp seal is formed. As the handles 114 are pivoted inwardly, the pivot pin 150 moves upward in the slotted opening 152.

When the seal S is crimped, the position of the various component of the tool 110 are such that an angle $\alpha$ is defined by the respective center lines (axes) of the link pins 140, the handle pins 136 and the pivot pin 150. The angle $\alpha$ is, when the tool 110 is in the crimped position, at less than or about 90 degrees. This angle $\alpha$ provides high leverage of the jaws 118, without over-rotation of the handles 114, and without a subsequent reduction in force and/or leverage at the jaws 118. When the tool 110 is closed, with or without a seal S in the jaws 120, an angle $\beta$ is defined by the two handle pins 136 and the pivot pin 150. When in the crimped position, the angle $\beta$ approaches about 180 degrees. This feature prevents over-rotation of the handles 114 (e.g., beyond 180 degrees) and a subsequent reduction in force and/or leverage at the jaws 120. This also prevents the handles 114 from prematurely opening after the seal is formed. The crimped position is that position at which the closing effort is greatest and, as such, the 90 degree angle $\alpha$ is the angle at which maximum force is applied.

In order to use the tool 110 with other size seals S (for example, a larger seal), the link pins 140 are removed, the shears 122 are removed and rotated 180 degrees (turned-over) to position the smaller of the receiving regions 123*b* (notches) for use, and the link pins 140 reinstalled. Crimping the seal S is carried out in a like manner.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A crimping tool for applying a deformable crimp seal onto overlapping layers of strap material, comprising:

a tool head;

pairs of jaws disposed in the tool head and operably mounted thereto, each pair including opposingly oriented jaw elements, each pair being spaced from its adjacent pair, each jaw element including an upper pivot opening and a lower pivot opening;

a shear positioned between adjacent pairs of jaw elements, the shear extending straight between the jaw elements, the shear including opposing openings, the openings aligning with the jaw element upper openings;

a pair of handles, the handles having a terminal end having first openings therein aligned with the jaw element lower openings and operably connected to one another at respective pivot openings;

at least one side plate, the side plate having a pair of upper openings, each aligned with the jaw element upper openings and the shear openings, the at least one side plate including a centrally disposed elongated, slotted opening;

a pair of handle pins, each handle pin disposed in a respective handle first opening and a respective jaw element lower opening;

a pair of link pins, each link pin disposed in a respective side plate upper opening and a respective jaw element upper opening and a shear opening; and a pivot pin disposed in the side plate elongated, slotted opening and in the handle pivot openings, wherein when the tool is in a crimped position an angle of less than or equal to about 90 degrees is defined by the respective center lines of the link pins, the handle pins and the pivot pin, wherein an angle approaching about 180 degrees is defined by the two handle pins and the link pin, and wherein the pivot pin moves in the elongated, slotted opening as the tool is operated between an open position and the crimped position.

2. The crimping tool of claim 1 including stops disposed to prevent over rotation of the handles in the open position.

3. The crimping tool of claim 2 wherein the stops are pins disposed in the shears.

4. The crimping tool of claim 1 including a connecting plate having two openings therein, a first opening for receipt of a handle pin and aligning with one of the handle first openings and a respective jaw element lower opening and a second opening for receipt of the link pin and aligning with the handle pivot openings and the side plate elongated, slotted opening.

5. The crimping tool of claim 1 wherein the shear includes a receiving region in which the deformable crimp seal is positioned.

6. The crimping tool of claim 1 wherein the shear has first and second receiving regions in first and second sides, respectively.

7. The crimping tool of claim 6 wherein the first and second receiving regions are configured to support different sizes of seals.

8. A crimping tool for applying a deformable crimp seal onto overlapping layers of strap material, comprising:

a tool head;

a pair of opposing jaw elements operably mounted in the head, each jaw element including an upper pivot opening and a lower pivot opening;

a shear extending between the jaw elements, the shear including opposing openings aligned with respective jaw element upper openings;

a pair of handles, the handles having a terminal end having first openings therein aligned with the respective jaw element lower openings and operably connected to one another at respective pivot openings;

at least one side plate, the side plate having a pair of upper openings, each aligned with the jaw element upper openings and the shear openings, the at least one side plate including a centrally disposed elongated, slotted opening;

a pair of handle pins, each handle pin disposed in a respective handle first opening and a respective jaw element lower opening;

a pair of link pins, each link pin disposed in a respective side plate upper opening and a respective jaw element upper opening and a shear opening; and a pivot pin disposed in the side plate elongated, slotted opening and in the handle pivot openings, wherein when the tool is in a crimped position, a first angle is defined by the respective center lines of the link pins, the handle pins and the pivot pin, and a second angle is defined by the two handle pins and the link pin, and wherein the pivot pin moves in the elongated, slotted opening as the tool is operated between and open and a closed position.

9. The crimping tool of claim 8 including multiple pairs of jaw elements and multiple shears, the shears disposed between pairs of jaw elements.

10. The crimping tool of claim 8 wherein the shear includes first and second receiving regions configured to receive seals of different sizes.

11. The crimping tool of claim 10 wherein a smaller receiving region is defined by a notch in an anvil surface of the shear.

12. The crimping tool of claim 8 including stops disposed to prevent over rotation of the handles in the open position.

13. The crimping tool of claim 12 wherein the stops are stop pins.

14. The crimping tool of claim 13 wherein the stop pins are positioned in the shear.

15. The crimping tool of claim 8 wherein the first angle is less than or equal to about 90 degrees.

16. The crimping tool of claim 8 wherein the second angle approaches about 180 degrees.

* * * * *